United States Patent [19]

Jankowski, Jr.

[11] 3,963,230

[45] June 15, 1976

[54] STUD AND BEAM CLAMP

[76] Inventor: John J. Jankowski, Jr., 2511 N. Richmond St., Chicago, Ill. 60647

[22] Filed: Nov. 11, 1974

[21] Appl. No.: 522,588

[52] U.S. Cl. ..... 269/41; 269/157; 269/224; 269/240; 269/254 R

[51] Int. Cl.[2] ..... B25B 1/00

[58] Field of Search ..... 269/37, 40–42, 269/157, 160, 172, 219, 224, 240, 245, 254; 52/584

[56] References Cited

UNITED STATES PATENTS

| | | | |
|---|---|---|---|
| 2,285,295 | 6/1942 | Martindell | 269/157 |
| 2,464,842 | 3/1949 | Altmayer | 269/254 |
| 2,761,476 | 9/1956 | Gunas | 269/41 |
| 2,770,271 | 11/1956 | Kane | 269/245 |
| 2,792,037 | 5/1957 | Kenfield | 269/157 |
| 2,794,467 | 6/1957 | Sitton | 269/240 |
| 3,086,510 | 4/1963 | Kranak | 269/160 |
| 3,279,140 | 10/1966 | Oliver | 52/584 |

*Primary Examiner*—Al Lawrence Smith
*Assistant Examiner*—Robert C. Watson
*Attorney, Agent, or Firm*—John J. Kowalik

[57] ABSTRACT

A clamp assembly comprising a pair of cooperating L-shaped clamp jaws, interconnected by a draw screw. The jaws are adjustable 360° about each other and are invertable. A shock absorbing block of elastomer material is interposed between the clamp members and compressed thereby against the beams being clamped to securely hold them in selected position and providing a shock transmitting means resisting displacement of the beams during nailing.

6 Claims, 4 Drawing Figures

FIG. 1
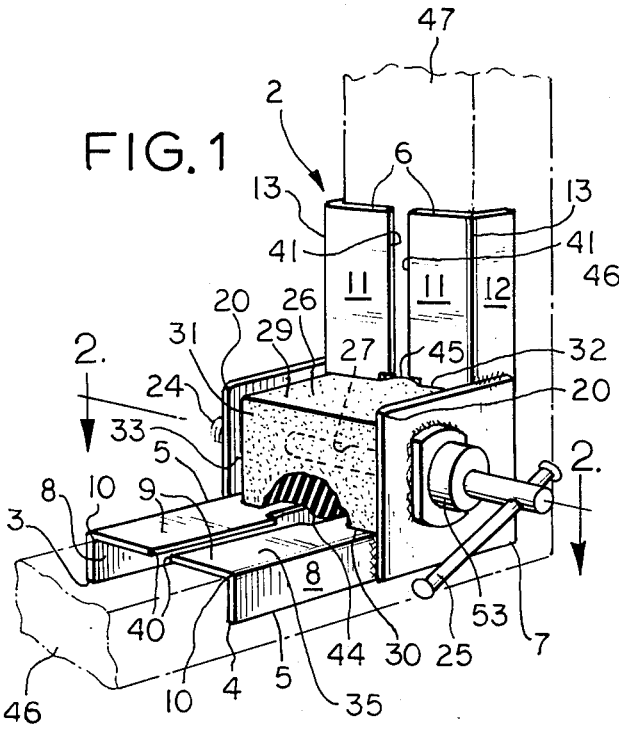
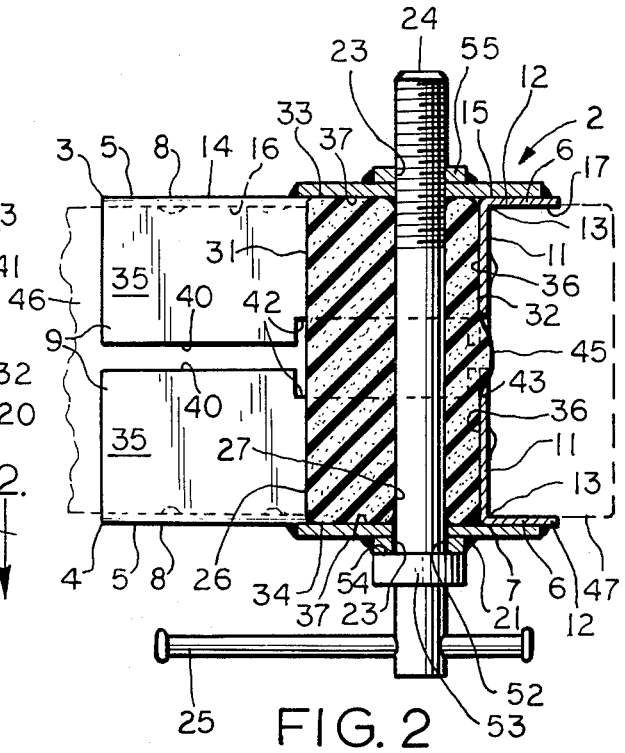
FIG. 2
FIG. 3
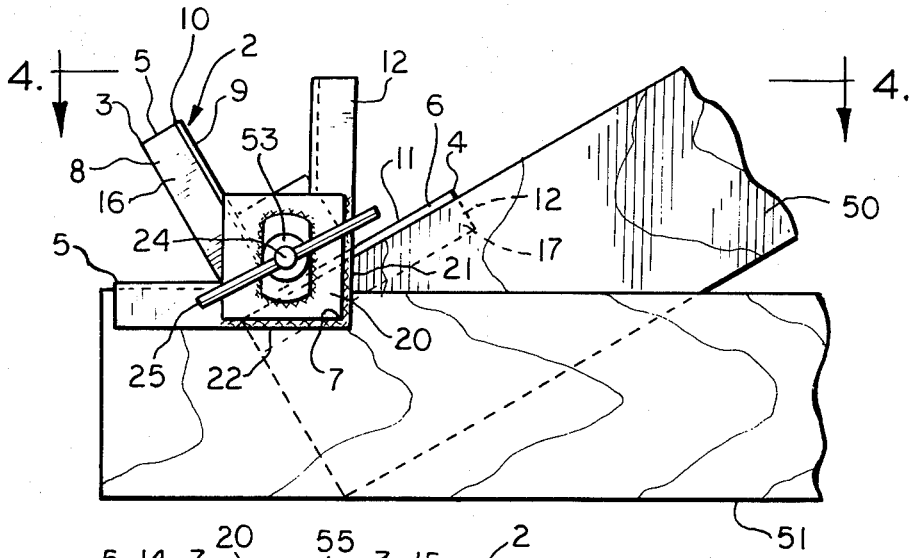
FIG. 4
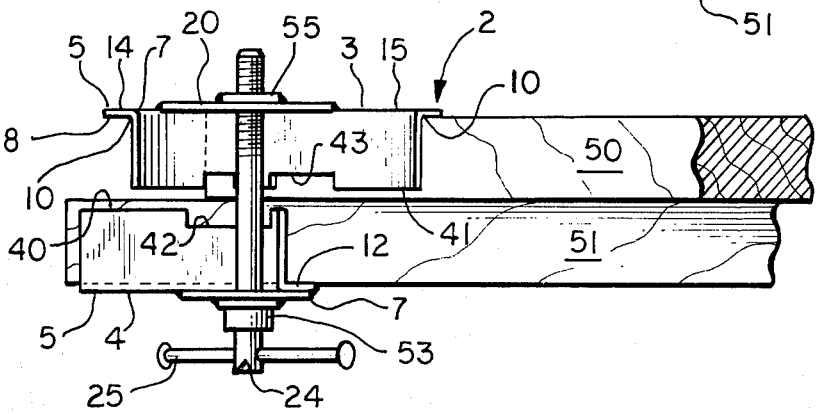

STUD AND BEAM CLAMP

DISCUSSION OF THE PRIOR ART

This invention appertains to clamps and more specifically to a novel two-piece clamp which is adjustable transversely but also circumferentially to various angular relationships.

Another object of the invention is to devise a novel clamp having a pair of opposing jaws interconnected by a draw screw, each jaw being angularly independently displaceable about the screw and having angularly disposed areas for grasping a portion of a beam therein.

A further object is to provide a clamp having opposed jaw structures, each including angularly related portions adapted to engage a side and an edge of a board or beam and draw the same against another beam held similarly by the other jaw and hold the beams together for nailing or gluing.

A principal object is to devise a clamp with means operative to impose a resilient load between the beams being clamped to provide a temporary yieldable shock transmitting device therebetween.

A corollary object is to provide a resilient block between the clamps arranged to be distorted by the clamping jaws into contact with the beams being clamped together to develop frictional purchase therewith resisting displacement during nailing of the beams together.

A still further object is to provide a novel resilient back-up for the clamping jaws so that they may be of simple and inexpensive construction.

These and other objects and advantages inherent in and encompassed by the invention will become more readily apparent from the specification and the drawings, wherein:

FIG. 1 is a perspective view of the invention showing the beams in phantom lines;

FIG. 2 is an enlarged horizontal cross-sectional view taken substantially on line 2—2 of FIG. 1;

FIG. 3 is an enlarged side elevational view; and

FIG. 4 is a sectional view taken substantially on line 4—4 of FIG. 3.

DESCRIPTION OF THE INVENTION

The metal clamp, generally designated 2, is preferably made of steel and comprises a pair of symmetrical L-shaped jaw elements 3 and 4.

Each jaw element has a pair of angle iron legs 5 and 6 which are interconnected at adjacent ends as by welding and form corner structures 7. The legs 5 and 6 are related at 90° to each other.

Leg 5 has integrally united flanges 8 and 9 disposed at a right angle to each other and joined in an apex 10, and leg 6 has similarly disposed flanges 11 and 12 which merge into an apex 13.

The apices 10 and 13 are coplanar. Flanges 8 and 12 are also coplanar and flanges 9 and 11 are normal to each other. Also the outer faces 14, 15 of flanges 8 and 12 are coplanar and inner faces 16, 17 are coplanar.

The legs 5 and 6 of each jaw element are interconnected by a corner or abutment plate 20 which is preferably welded at 21,22 to the exterior sides of these legs. The plates 20 of the two jaw elements are provided with transverse apertures 23, through which is passed a threaded draw or vise screw 24 which is provided with a handle 25 at one end for rotating and tightening the jaws as hereinafter described.

A block 26 of elastomer material such as rubber or any synthetic material such as neoprene is sleeved over the screw and has a close fitting aperture 27 therein accommodating the screw 23 therethrough. The block is preferably of rectangular shape having top and bottom sides 29,30 and lateral sides 31,32 and squared off ends 33,34.

As best seen in FIG. 2, the block seats at its bottom side 30 on the coplanar top sides 35,35 of the flanges 9,9 and at its inner lateral side 32 against the coplanar faces 36,36 of the flanges 12,12. The end faces 33,34 seat against the internal opposing sides 37,37 of the bracing plates 20.

It will be appreciated that the elastomer block not only backs up the corner and the legs of the clamp elements but in being compressed, the block being longer than the minimum spacing between the jaw elements, the block grasps the screw and thus serves as a friction lock holding the screw from unwinding when nails are being pounded through the wooden frame beam members.

It will also be observed that each jaw has in the inner edges 40,40 and 41,41 of flanges 9 and 12 recesses 42,42 and 43,43 which are covered by the adjacent portions of the block. The distortion of the block causes it to form bulges 44,45 which project through the recesses and frictionally engage the beams 46,47 as best seen in FIG. 2. Thus, upon nailing of the beams, the hammering shock is transmitted through the block from one beam to other. Also, the direct engagement of the block with the beams prevents slippage due to the high coefficient of friction therebetween.

As best seen in FIGS. 1 and 2, the beams are shown in a stud and plate arrangement wherein the beam 46 forms the base of a wall and beam 47 forms the upright of the wall.

In FIGS. 3 and 4 the beams are positioned side by side illustrating the joining of a roof rafter 50 to tie beam 51.

The screw 24 passes through a universal connection 52 secured to one of the plates 20 and has a stop 53 engaging the external side 54 of the adjacent plate 20. The screw is threaded into a universal connection 55 secured to the other plate 20.

It will be observed that the vise clamp of the present invention may be used with or without the yieldable block and that the block may be used in any of the applications to which the clamp is adapted.

Having described a preferred form of the invention, it will be apparent to those skilled in the art that various other modifications can be devised which fall within the scope of the appended claims.

I claim:

1. A clamp comprising a pair of opposed jaws presenting opposing abutment elements, a deformable elastomer member interposed between said elements, said jaws defining angularly offset passages accommodating deformation of said member therethrough for engagement with associated parts clamped by said jaws, and means for drawing the jaws into clamping position and deforming said member.

2. The invention according to claim 1 and said drawing means comprising a screw extending through said abutment elements and said elastomer member.

3. The invention according to claim 2 and said member and jaws having angularly related complementally fitting side portions, said side portions on the jaws confining said member and controlling the deformation thereof.

4. The invention according to claim 1 and said elastomer member being compressible between said abutment elements and transaxially deformable with respect to said drawing means and engagable therewith for holding the same in selected adjusted position.

5. A clamp comprising a pair of opposing jaw elements, draw screw means interconnecting said elements for adjusting said elements, and a block of elastomer material sleeved on said screw means between said jaw elements for compression by and between said jaw elements and deformation into frictional contact with said draw screw means.

6. The invention according to claim 5 and said clamping portions embracing said block of elastomer material and said elements defining spaces therebetween accommodating bulging of said block therethrough for abutment with associated members clamped between said elements.

* * * * *